US009166381B2

(12) United States Patent
Hayashi et al.

(10) Patent No.: US 9,166,381 B2
(45) Date of Patent: Oct. 20, 2015

(54) IGNITION DEVICE WITH IGNITION COIL

(71) Applicant: DENSO CORPORATION, Kariya, Aichi-pref. (JP)

(72) Inventors: Naoto Hayashi, Kakamigahara (JP); Kanechiyo Terada, Handa (JP); Takashi Oono, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/202,841

(22) Filed: Mar. 10, 2014

(65) Prior Publication Data

US 2014/0252976 A1 Sep. 11, 2014

(30) Foreign Application Priority Data

Mar. 8, 2013 (JP) ..... 2013-046340
Mar. 8, 2013 (JP) ..... 2013-046341

(51) Int. Cl.
*F02P 3/06* (2006.01)
*H01T 15/00* (2006.01)

(52) U.S. Cl.
CPC ..... *H01T 15/00* (2013.01)

(58) Field of Classification Search
USPC ..... 123/604, 605, 609, 620, 630, 637, 644
See application file for complete search history.

(56) References Cited

U.S. PATENT DOCUMENTS 4,964,377 A * 10/1990 Scarnera ..... 123/605
5,024,204 A * 6/1991 Dykstra ..... 123/406.57
5,365,910 A * 11/1994 Miyata et al. ..... 123/627
6,151,954 A * 11/2000 Aoki et al. ..... 73/35.08
6,305,365 B1 * 10/2001 Maeoka et al. ..... 123/604
6,378,513 B1 * 4/2002 Boyer et al. ..... 123/625
6,539,930 B2 * 4/2003 Inagaki ..... 123/655
2003/0168049 A1 * 9/2003 Zarkhin et al. ..... 123/609

FOREIGN PATENT DOCUMENTS

JP 5-312094 11/1993
JP 06-80313 10/1994
JP 2001-193622 7/2001
JP 2012-177310 9/2012

OTHER PUBLICATIONS

Office Action (3 pgs.) dated Jul. 28, 2015 issued in corresponding Japanese Application No. 2013-046340 with an at least partial English-language translation (2 pgs.).

* cited by examiner

*Primary Examiner* — Tung X Le
(74) *Attorney, Agent, or Firm* — Nixon & Vanderhye P.C.

(57) ABSTRACT

An ignition device includes an ignition coil with a primary coil and a secondary coil, a spark plug with center and ground electrodes for discharge therebetween, and a voltage limiting circuit. The voltage limiting circuit limits voltage applied between the electrodes of the spark plug such that the voltage has an absolute value limited within a predetermined voltage limiting value. The voltage limiting value is differentiated from each other in first and second stages. The first stage is defined as a period in which an initial discharge peak ends, the initial discharge peak being initially generated by electric energy. The second stage is defined as a period after the end of the initial discharge peak. The voltage limiting value in the first stage is lower than the voltage limiting value in the second stage.

19 Claims, 4 Drawing Sheets

IGNITION DEVICE WITH IGNITION COIL

CROSS-REFERENCE TO RELATED APPLICATION

This application is based on and claims the benefit of priorities from earlier Japanese Patent Application Nos. 2013-046340 and 2013-046341 both filed Mar. 8, 2013, the descriptions of which are incorporated herein by reference.

BACKGROUND OF THE INVENTION

1. Technical Field

The present invention relates to an ignition device that includes an ignition coil composed of a primary coil and a secondary coil that is magnetically coupled with the primary coil, and a spark plug that generates discharge sparks between a center electrode and a ground electrode with the application of a high voltage between the electrodes responsively to the magnetic energy stored in the ignition coil.

2. Related Art

It is a recent trend to use a supercharger or the like to raise the compression ratio of a gasoline engine, for the purpose of achieving downsizing and thereby improving fuel consumption or reducing cost. A high compression ratio leads to a high in-cylinder pressure at the time when discharge sparks are generated in the spark plug and accordingly leads to a high discharge voltage of the spark plug. The high discharge voltage leads to an early excess of the discharge voltage over the insulation breakdown critical voltage of the plug insulator if consumption has progressed in the electrodes of the spark plug due, for example, to the increase of travel distance. This may impair the reliability of the spark plug, disable generation of discharge sparks and may cause misfire in the engine.

As a measure against such a problem, the inventors of the present invention have recognized the importance of a technique of limiting the discharge voltage of a spark plug to a predetermined voltage, using constant voltage elements, such as Zener diodes or varistors, as disclosed in a patent document JP-B-H06-080313. This technique is specifically described as follows. The ignition coil of a spark plug has secondary-side ends one of which is connected to the center electrode of the spark plug and to a constant voltage element. The constant voltage element allows passage of electric current when the voltage between the terminals becomes equal to or larger than the predetermined voltage. Of the two terminals of the constant voltage element, the one opposite to the center electrode side terminal is grounded.

According to such a configuration, when the voltage applied between the electrodes of the spark plug is about to exceed the predetermined voltage, the application voltage is limited to the predetermined voltage and flattened. Then, the gas in a gap is brought into a condition suitable for discharge during the period when the application voltage is maintained at the predetermined voltage. As a result, discharge sparks are generated between the electrodes. Thus, the discharge voltage of the spark plug is prevented from becoming excessively high. In this way, the reliability of the spark plug is prevented from being impaired.

The inventors of the present invention have obtained knowledge as set forth below.

According to the knowledge, use of the technique mentioned above can prevent the excessive increase of the discharge voltage of the spark plug, but the sparks are blown such as by the flow of unburned gas after start of discharge, causing what is called blow-off. The blow-off may again cause voltage rise if the induced electric power still remains in the secondary coil and cause re-discharge that may accelerate consumption of the plug electrodes. According to the knowledge, the consumption of the plug electrodes due to re-discharge is reduced by lowering the voltage value at the time of the re-discharge.

Specifically, under the condition that a flow of gas is large in the vicinity of the spark discharge gap of a spark plug, initial discharge is followed by re-discharge which may cause consumption in the electrodes. More specifically, initial discharge is caused by the electric energy supplied to the spark plug from the ignition coil, which is followed by the occurrence of inductive discharge. Then, the inductive discharge may be flowed and blown off by the flow of gas in the combustion chamber. However, the applied electric energy, if it remains in the spark plug, may cause re-discharge. Repetition of the re-discharge may consume the electrodes. Usually, the voltage of such re-discharge is not as high as the voltage of the initial discharge. However, repetition of re-discharge with a somewhat high voltage is not desirable from the viewpoint of enhancing consumption resistance of the electrodes. The repetition of re-discharge is not also desirable because capacitive discharge caused at the initial rise of re-discharge will further accelerate the consumption in the electrodes.

On the other hand, in order to generate spark discharge between the electrodes of the spark plug by the electric energy supplied from the ignition coil, the voltage between the electrodes is required to be increased to some extent.

In general, an internal combustion engine, such as an engine for a vehicle, is configured to generate spark discharge in the combustion chamber to thereby ignite a gas in the combustion chamber. For such an internal combustion engine, or for a lean-burn engine, in particular, various techniques have been developed to enhance combustibility by generating a flow of gas in the combustion chamber. In such an internal combustion engine, the spark discharge is elongated by the flow of gas to enhance the ignitability of the gas. However, if the flow of gas is strong, the spark discharge will be blown away, immediately followed by the occurrence of re-discharge. After the occurrence of re-discharge, the spark discharge may again be blown away due to the flow of gas. Thus, a phenomenon of repeating discharge may occur, or in other words, blow-off of discharge followed by re-discharge may repeatedly occur. The repetition of re-discharge may accelerate consumption in the electrodes of the spark plug.

As a measure against this, a patent document JP-A-2012-177310 suggests an ignition control apparatus for an internal combustion engine. Under the control of this ignition control apparatus, the successive re-discharge is inhibited under predetermined conditions.

However, the inhibition of re-discharge in the ignition control apparatus for an internal combustion engine as disclosed in the patent document JP-A-2012-177310 may extremely shorten the period of discharge. The extremely shortened period of discharge may lead to the occurrence of fire.

In a spark plug, capacitive discharge is caused by supplied electric energy, followed by inductive discharge. While the inductive discharge continues, blow-off and re-discharge repeatedly occur. During the repetition, the gas in the internal combustion engine is ignited by the discharge sparks.

In this regard, the ignition control apparatus described in the patent document JP-A-2012-177310 inhibits discharge after the initial capacitive discharge, that is, discharge is terminated without using the electric energy. As a result, the period of discharge is extremely shortened and the shortened period of discharge may become a cause of misfire.

On the other hand, there is a concern that, when the repetition of blow-off and re-discharge is tolerated, consumption may be accelerated in the electrodes of the spark plug.

SUMMARY

Hence it is desired to provide an ignition device which is able to retain ignitability but effectively minimize consumption in the electrodes of the spark plug.

According to one exemplary embodiment of the present technology, there is provided an ignition device, comprising: an ignition coil provided with a primary coil and a secondary coil which are magnetically coupled with each other; a spark plug provided with a center electrode and a ground electrode, discharge sparks being generated between the center electrode and the ground electrode by an application of voltage between the center and ground electrodes, the voltage being applied using electric energy responding to magnetic energy stored in the ignition coil; and a voltage limiting circuit for limiting the voltage applied between the electrodes of the spark plug such that the voltage has an absolute value limited below a predetermined voltage limiting value, wherein the voltage limiting value is different from each other in first and second stages, the first stage being defined as a period in which an initial discharge peak ends, the initial discharge peak being initially generated by the electric energy, the second stage being defined as a period after the end of the initial discharge peak, wherein the voltage limiting value in the first stage The voltage limiting circuit is configured such that the absolute value of the voltage applied to the spark plug will not exceed a predetermined voltage limiting value. Specifically, a voltage is applied between the electrodes of the spark plug by the electric energy supplied to the spark plug from the ignition coil. In this case, the applied voltage can be made equal to or smaller than the voltage limiting value. The voltage limiting value is different between the first and second stages. Thus, the discharge voltage of the spark plug can be well reduced in the first and second stages.

The voltage limiting value of the second stage is made smaller than the voltage limiting value of the first stage. In other words, while the voltage limiting vale of the first stage is maintained at a somewhat high level, the voltage limiting value of the second stage can be set to a low level.

Thus, at the first stage, the discharge voltage peak that initially occurs in the spark plug by the electric energy supplied to the spark plug is permitted to occur with a somewhat high voltage. Accordingly, a spark discharge is generated in the spark discharge gap between the center electrode and the ground electrode without causing insulation breakdown in portions other than the spark discharge gap. In other words, the initial discharge is reliably generated and fire is resultantly prevented from occurring in the internal combustion engine.

On the other hand, at the second stage, voltage can be reduced in a re-discharge that could successively occur after the initial discharge. This may suppress consumption in the electrodes of the spark plug due to the repetition of re-discharge.

As described above, according to the present invention, an ignition device is provided, which is able to ensure ignitability but effectively minimize consumption in the electrodes of the spark plug.

For example, the ignition device described above may be used in an internal combustion engine of a vehicle.

A gas that is a mixture of fuel and air, for example, is supplied to the combustion chamber of an internal combustion engine that installs the spark plug. It is preferable that a flow of gas is generated in the combustion chamber. For example, the flow of gas may be a tumble flow, a swirl flow or a flow that is a combination of these flows.

For example, capacitive discharge occurs when electric charge stored in an internal electrostatic capacity of the ignition coil is discharged. Other than the capacitive discharge, the spark discharge in a spark plug also includes inductive discharge. The inductive discharge occurs when electromagnetic induction energy in the ignition coil is discharged.

An initially occurring discharge refers to a discharge that initially occurs with a single supply of energy to the spark plug from the ignition coil. Specifically, energy is repeatedly and intermittently supplied from the ignition coil to the spark plug at predetermined timing. In this case, the capacitive discharge that initially occurs in the spark discharge gap of the spark plug with each energy supply corresponds to the "initially occurring discharge" mentioned above. In the present specification, this is also expressed, as appropriate, as "initial discharge" or the like.

For example, the voltage limiting value of the first or second stage may be appropriately set according to the specification of the internal combustion engine, the specification of the spark plug, or the like. The voltage limiting value of the first stage is set, for example, to a level that can ensure the initial discharge but reduce the discharge voltage. For example, the voltage limiting value of the first stage may be any value in a range of 20 to 50 kV. In particular, the voltage limiting value of the first stage may preferably be about kV, taking account of the individual withstand voltage specifications of the spark plug and the ignition coil components or the ignition voltage characteristics of the engine.

Further, for example, the voltage limiting value of the second stage is set to a level that can well minimize consumption in the electrodes of the spark plug due to the repetition of re-discharge but can well ensure ignitability based on the re-discharge following the initial discharge. For example, the voltage limiting value of the second stage may be any value in a range of 1 to 20 kV.

For example, the voltage limiting circuit is configured such that the voltage limiting values in the first and second stages are interchangeable.

In this case, the voltage limiting value of the first stage and the voltage limiting value of the second stage, which is smaller than that of the first stage, can be easily set.

For example, the voltage limiting circuit is arranged to be connected to the secondary coil.

In this case, the voltage limiting value of the first or second stage can be more correctly set. Specifically, although the voltage limiting circuit may be provided on the primary coil side, a more correct voltage limiting value can be set when the voltage limiting circuit is provided on the secondary coil side.

By way of example, the voltage limiting circuit is provided with a switching element electrically and selectively turned on and off and a plurality of constant voltage elements each electrically driven.

In this case, the voltage limiting values can be easily interchanged and correctly set. Further, use of the constant voltage elements enables fine setting of the voltage limiting value. For example, the constant voltage elements include Zener diodes, avalanche diodes, varistors, or the like. For example, the switching element includes MOSFET (MOS type field-effect transistor), IGBT (insulated gate bipolar transistor), or the like.

For example, the plurality of constant voltage elements are electrically connected in series to each other; the switching element is electrically connected to a path connecting two constant voltage elements electrically connected to each other, the two constant voltage elements being included in the plurality of constant voltage elements; and the voltage limiting circuit is electrically parallelly connected with the spark plug.

In this case, since the pair of constant voltage elements are connected in series, the electric energy being discharged in the voltage limiting circuit can be discharged, being dispersed in the plurality of constant voltage elements. In other words, the generated heat accompanying the emission of the electric energy can be dispersed to the plurality of Zener diodes. Thus, heat diffusion in portions of the device can be suppressed, easily enabling size reduction or elimination of a heat diffusing circuit. In addition, since the withstand voltage of the constant voltage elements is reduced, the size and cost of the device can be easily reduced.

According to a second aspect of the present technology, there is provided an ignition device, comprising: an ignition coil provided with a primary coil and a secondary coil which are magnetically coupled with each other; a spark plug provided with a center electrode and a ground electrode, discharge sparks being generated between the center electrode and the ground electrode by an application of voltage between the center and ground electrodes, the voltage being applied using electric energy responding to magnetic energy stored in the ignition coil; and a voltage limiting circuit for limiting the voltage applied between the electrodes of the spark plug such that the discharge between the electrodes is permitted but the voltage applied between the electrodes after an end of an initial discharge voltage peak has an absolute value limited below a predetermined voltage limiting value, the initial discharge voltage peak being initially generated by the electric energy.

The voltage limiting circuit is configured such that discharge is tolerated after lapse of the initially occurring discharge voltage peak, but that the absolute value of the voltage applied to the spark plug is ensured not to exceed the predetermined voltage limiting value. Thus, the electric energy supplied to the spark plug is fully used after lapse of the initial discharge voltage peak as well to ensure ignitability of gas but, at the same time, consumption of the spark plug is minimized. In other words, discharge is permitted to successively occur without interruption after lapse of the initial discharge voltage peak as well, thereby ensuring ignitability fully using the electric energy supplied to the spark plug. At the same time, the absolute value of the voltage of the discharge (re-discharge) that successively occurs after lapse of the initial discharge voltage peak can be made equal to or smaller than the predetermined voltage limiting value. Thus, when the predetermined voltage limiting value is set to a value that would hardly induce consumption of the spark plug, consumption of the spark plug is minimized but, at the same time, the ignitability is ensured.

Further, the voltage limiting circuit may be appropriately set according, for example, to the specification of the internal combustion engine or the specification of the spark plug. For example, the voltage limiting value may be set to a level that can sufficiently minimize consumption in the electrodes of the spark plug caused by the repetition of re-discharge following the initial discharge, but can ensure ignitability based on the re-discharge. For example, the voltage limiting value may be set to a level of 1 to 20 kV that can maintain the inductive discharge voltage.

For example, the voltage limiting circuit is provided with a switching element electrically and selectively turned on and off and a constant voltage element electrically driven.

In this case, the voltage limiting circuit can be correctly set at desired timing. Further, use of a constant voltage element enables fine setting of the voltage limiting value. For example, a Zener diode, an avalanche diode, a varistor or the like may be used as the constant voltage element. Also, for example, a MOSFET (MOS type field-effect transistor), an IGBT (insulated gate bipolar transistor) or the like may be used as the switching element.

Still, the voltage limiting circuit may be arranged to be connected to the primary coil.

In this case, the withstand voltage of the switching element or the constant voltage element can be made small to easily reduce the size and cost of the device.

DETAILED DESCRIPTION OF THE PREFERRED EMBODIMENTS

First Embodiment

Figure 1:
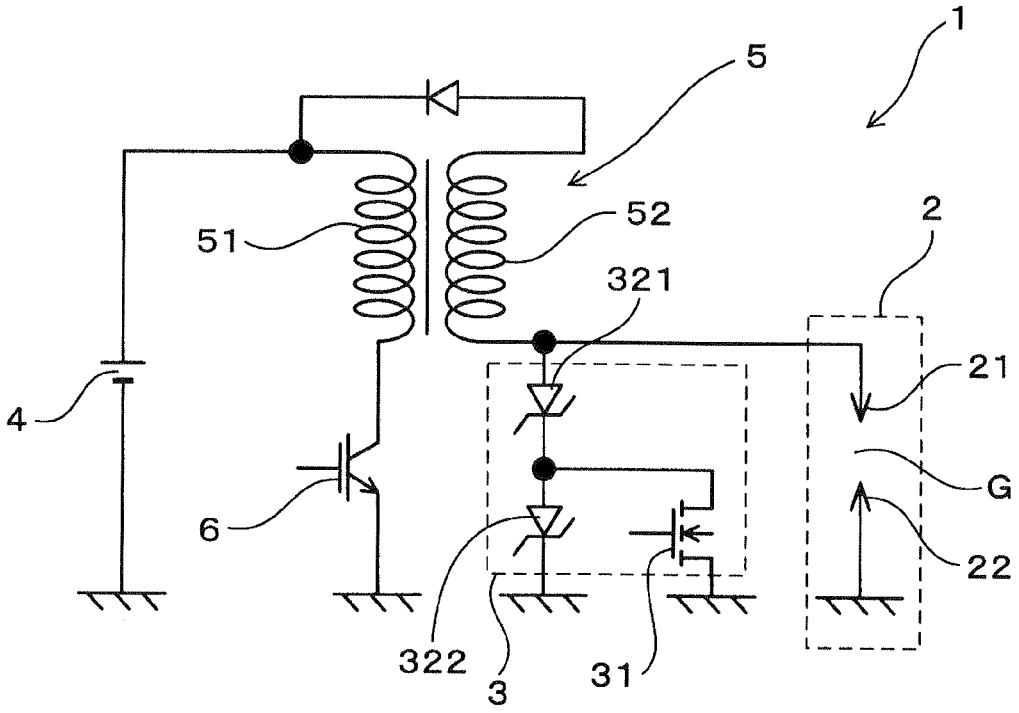
FIG. 1 is a schematic circuit diagram illustrating an ignition device according to a first embodiment of the present invention.
Figure 2:
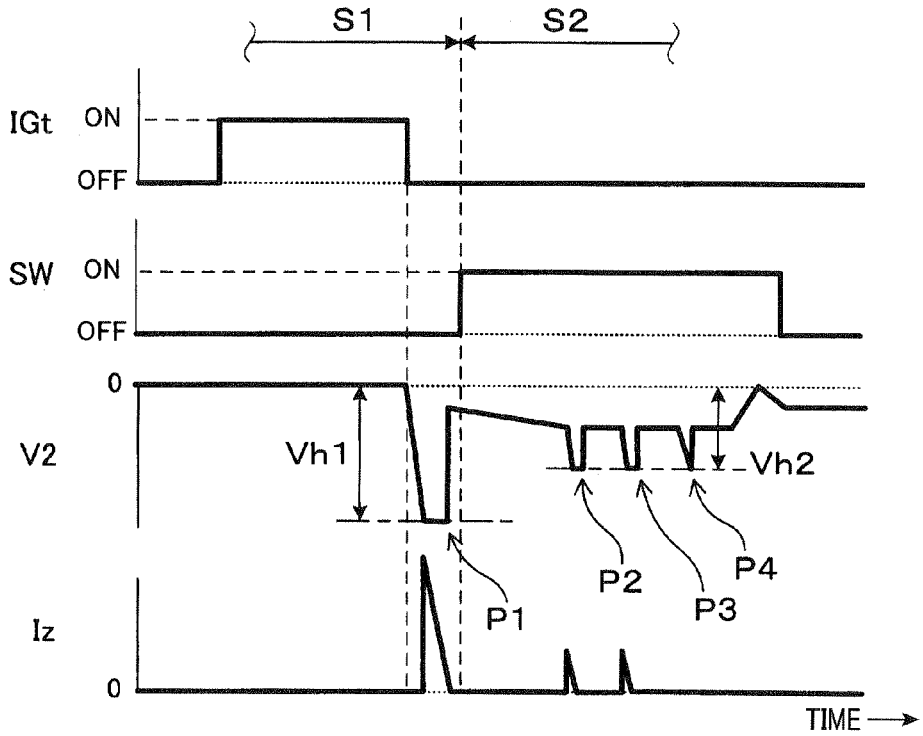
FIG. 2 is a diagram illustrating an operation of a voltage limiting circuit and time variation of secondary voltage and electric current that passes through a Zener diode near a secondary coil, according to the first embodiment.

Referring to FIGS. 1 and 2, hereinafter is described a first embodiment of an ignition device according to the present invention.

FIG. 1 is a schematic circuit diagram illustrating an ignition device 1 according to the first embodiment. As shown in FIG. 1, the ignition device 1 includes an ignition coil 5, a spark plug 2 and a voltage limiting means (i.e. a voltage limiting circuit) 3.

The ignition coil 5 includes a primary coil 51 and a secondary coil 52 which is magnetically coupled with the primary coil 51. The spark plug 2 generates discharge sparks between a center electrode 21 and a ground electrode 22 with the application of a voltage between the electrodes, on the basis of the magnetic energy stored in the ignition coil 5. The voltage limiting means 3 limits a voltage V2 applied between the electrodes of the spark plug 2 so that the absolute value of the voltage V2 will not exceed a predetermined voltage limiting value.

As shown in FIG. 2, discharge includes a first stage S1 and a second stage S2. The first stage S1 lasts until the end of a peak of discharge voltage (discharge voltage peak) which initially occurs in the spark plug 2 by the electric energy supplied from the ignition coil 5. The second stage S2 is a period following the first stage S1. As will be seen from FIG. 2, the voltage limiting value is different between the first and second stages S1 and S2. A voltage limiting value Vh2 of the second stage S2 is smaller than a voltage limiting value Vh1 of the first stage S1.

The ignition device 1 also includes an igniter 6 that supplies current to the primary coil 51 or interrupts current to be supplied to the primary coil 51. The voltage limiting means 3 is configured to be able to interchange the two voltage limiting values Vh1 and Vh2 so that either value can be set. The voltage limiting means 3 is provided on the secondary coil 52 side and includes a single switching element 31 and two Zener diodes 321 and 322 as constant voltage elements. The two Zener diodes 321 and 322 are connected to each other in series. The switching element 31 is connected to a connecting point between the pair of serially connected Zener diodes 321 and 322. The voltage limiting means 3 is connected in parallel with the spark plug 2.

The spark plug 2 includes a center electrode 21 and a ground electrode 22. A spark discharge gap G is formed between the center electrode 21 and the ground electrode 22. The ground electrode 22 is grounded. The center electrode 21 is configured to have a lower potential than the ground electrode 22. In other words, with the application of a voltage between the center electrode 21 and the ground electrode 22 by the ignition coil 5, the potential of the center electrode 21 turns to negative.

For example, the ignition device 1 of the present embodiment may be used for an internal combustion engine of a vehicle. A mixed gas of fuel and air, for example, is supplied to the combustion chamber. For example, a flow of gas occurs in the combustion chamber, such as a tumble flow, a swirl flow or a flow that is a combination of these flows.

The ignition device 1 includes a power source 4 as a direct-current power source having a positive terminal connected to the primary coil 51 of the ignition coil 5. The primary coil 51 includes a terminal connected to the igniter 6, the terminal being on the opposite side of the terminal thereof connected to the power source 4. The igniter 6 is composed of a switching element and configured to be turned on/off under the control of a signal from an electronic control unit of the internal combustion engine, not shown.

The secondary coil 52 of the ignition coil 5 is connected to the center electrode 21 of the spark plug 2. Further, the secondary coil 52 is electrically connected to the voltage limiting means 3 that is in parallel with the spark plug 2. Specifically, the pair of serially connected Zener diodes 321 and 322 is connected to the secondary coil 52 on a side where the secondary coil 52 is connected to the spark plug 2. The cathode of the Zener diode 321 is connected to the anode of the Zener diode 322 so that these diodes are connected in series to each other. The anode of the Zener diode 321 is connected to the secondary coil 52, while the cathode of the Zener diode 322 is grounded.

The Zener diodes 321 and 322 are connected to each other via a connecting point. The switching element 31 is connected between this connecting point and the ground. The switching element 31 is also configured to be turned on/off under the control of a signal from the electronic control unit of the internal combustion engine, not shown. When the switching element 31 is in an on state, the absolute value of the secondary voltage V2 applied to the spark plug 2 has an upper limit equivalent to a Zener voltage Vz1 of the Zener diode 321. On the other hand, when the switching element 31 is in an off state, the absolute value of the secondary voltage V2 has an upper limit equivalent to the sum of the Zener voltage Vz1 of the Zener diode 321 and a Zener voltage Vz2 of the Zener diode 322, as expressed by Vz1+Vz2.

For example, the Zener voltages Vz1 and Vz2 may be Vz1=10 kV and Vz2=25 kV, respectively. In the present embodiment, a MOSFET (MOS type field-effect transistor) is used as the switching element 31 of the voltage limiting means 3, and an IGBT (insulated gate bipolar transistor) is used as the switching element configuring the igniter 6.

As described above, the voltage limiting means (i.e., the voltage limiting circuit) 3 is configured such that the absolute value of the voltage V2 applied to the spark plug 2 will not exceed a predetermined voltage limiting value. In this case, the voltage limiting value is ensured to be different between the first and second stages S1 and S2 mentioned above. As a specific means for achieving this, the voltage limiting values Vh1 and Vh2 are configured to be interchanged by turning on/off the switching element 31. More specifically, at the first stage S1, the switching element 31 is turned off so that the voltage limiting value Vh1 will be Vz1+Vz2. Also, at the second stage S2, the switching element 31 is turned on so that the voltage limiting value Vh2 will turn to Vz1.

Referring to FIG. 2, hereinafter is described an operation of the ignition device 1 that includes the voltage limiting means 3 configured as described above. FIG. 2 is a diagram illustrating an operation of the voltage limiting means 3 and time variation of the secondary voltage V2 and electric current that passes through the Zener diode 321 near the secondary coil 52. In FIG. 2, four graphs are vertically juxtaposed. In the graphs, each horizontal axis indicates a time axis. The symbol on the left of the vertical axis indicates an on/off state of the igniter 6 in the graph of IGt, an on/off state of the switching element 31 in the graph of SW, variation of the secondary voltage V2 in the graph of V2, and variation in the value of current that passes through the Zener diode 321 near the secondary coil 52 in the graph of Iz.

First, when the switching element of the igniter 6 is turned on, current passes through the primary coil 51. After that, when the igniter 6 is turned off, current supply to the primary coil 51 is interrupted. With the interruption, an induced electromotive force is generated in the secondary coil 52 and the secondary voltage V2 is applied between the center electrode 21 and the ground electrode 22 of the spark plug 2. This electric energy causes an initial discharge between the electrodes of the spark plug 2. The portion indicated by P1 in the graph of V2 in FIG. 2 corresponds to an initial discharge voltage peak.

A single turn on/off operation of the igniter 6 induces electric energy that is supplied from the ignition coil 5 to the spark plug 2. In the present embodiment, capacitive discharge initially occurs in the spark discharge gap G of the spark plug 2 by this electric energy is the initial discharge mentioned above.

At the first stage S1 that lasts until the end of the initial discharge voltage peak, the switching element 31 of the voltage limiting means 3 is in an off state. Therefore, as mentioned above, the voltage limiting means 3 allows the upper limit of Vz1+Vz2 for the absolute value (voltage limiting value Vh1) of the voltage V2 applied to the spark plug 2. Accordingly, the initial discharge has a somewhat high discharge voltage. Therefore, the initial discharge can be reliably caused.

After the initial discharge voltage peak has elapsed, the switching element 31 of the voltage limiting means 3 is turned on. Thus, as mentioned above, at the second stage S2, the voltage limiting means 3 allows the upper limit of Vz1 for the absolute value (voltage limiting value Vh2) of the voltage V2 applied to the spark plug 2. The voltage Vz1 is smaller than the voltage limiting value Vh1 (=Vz1+Vz2) at the first stage S1. Therefore, in the re-discharge that occurs in the second stage S2, the discharge voltage can be reduced.

Specifically, at the second stage S2, inductive discharge occurs between the electrodes of the spark plug 2. However, when the discharge is blown off, capacitive discharge or inductive discharge will occur again. The capacitive discharge (re-discharge) is indicated by point P2, P3 or P4 in the graph of V2 of FIG. 2. If the initial discharge has not achieved ignition, the gas can be ignited by re-discharge in the repetition of blow-off and re-discharge. However, the voltage of the re-discharge is suppressed to not more than the voltage limiting value Vh2. Thus, while consumption is minimized in the electrodes of the spark plug 2, a chance of ignition is ensured at the second stage S2.

Hereinafter are described advantageous effects of the present embodiment.

The voltage limiting means 3 is configured such that the absolute value of the voltage applied to the spark plug 2 will not exceed a voltage limiting value. In other words, a voltage is applied between the electrodes of the spark plug 2 by the electric energy supplied to the spark plug 2 from the ignition coil 5. In this case, this applied voltage is rendered to be not more than the voltage limiting value. The voltage limiting value is different between the first and second stages S1 and S2. Thus, the discharge voltage of the spark plug 2 is well reduced at the first and second stages S1 and S2.

Further, the voltage limiting value Vh2 of the second stage S2 is made smaller than the voltage limiting value Vh1 of the first stage S1. In other words, while the voltage limiting value Vh1 of the first stage S1 is maintained at a somewhat high level, the voltage limiting value Vh2 of the second stage S2 can be made small.

Thus, at the first stage S1, the initial discharge voltage peak in the spark plug 2 that occurs with the supply of the electric energy to the spark plug 2 is permitted to occur with a somewhat high voltage. Accordingly, spark discharge is permitted to occur in the spark discharge gap G between the center electrode 21 and the ground electrode 22 without causing insulation breakdown in portions other than the spark discharge gap G. In other words, the initial discharge is reliably caused and, as a result, fire is prevented from occurring in the internal combustion engine.

On the other hand, at the second stage S2, voltage can be reduced in capacitive discharge, i.e. re-discharge, that could successively occur after the initial discharge. Thus, the electrodes of the spark plug 2 are prevented from being worn out by the repetition of the re-discharge.

The voltage limiting means 3 is configured such that the voltage limiting value can be set by interchanging the two different values Vh1 and Vh2. This enables easy setting of the voltage limiting value Vh1 of the first stage S1 and the voltage limiting value Vh2 of the second stage S2, the latter being smaller than the former. Further, since the voltage limiting means 3 is provided on the secondary coil 52 side, the voltage limiting value Vh1 of the first stage S1 and the voltage limiting value Vh2 of the second stage S2 can be set more correctly.

The voltage limiting means 3 includes the switching element 31 and the two Zener diodes 321 and 322. This enables easy interchange between the voltage limiting values Vh1 and Vh2 and correct setting of the value Vh1 or Vh2. Also, use of the Zener diodes 321 and 322 enables fine setting of the voltage limiting value Vh1 or Vh2.

The two Zener diodes 321 and 322 are connected to each other in series, with a connecting point therebetween being connected to the switching element 31. Accordingly, the electric energy emitted in the voltage limiting means 3 can be emitted, being dispersed in the two Zener diodes 321 and 322. In other words, the generated heat that accompanies the emission of the electric energy can be dispersed to the plurality of Zener diodes. Thus, heat diffusion in portions of the device can be suppressed, easily reducing the size of a heat diffusing mans or easily eliminating the heat reading means. In addition, the withstand voltage of the Zener diode 321 or 322 can be reduced to easily realize reduction in size and cost. In other words, compared to an ignition device 10 of a second embodiment described later, size and cost reduction of the device can be easily sought for.

The two Zener diodes 321 and 322 may be integrated into a packaged component. In this case, the packaged component may be provided with three terminals that are connected to the secondary coil 52, the switching element 31 and the ground to thereby configure a part of the voltage limiting means 3 described above. Also, in this case, the size of the voltage limiting means 3 can be more easily reduced and accordingly size reduction of the entire ignition device 1 is more easily realized.

As described above, the present embodiment can provide an ignition device that ensures ignitability and effectively minimizes consumption in the electrodes of the spark plug.

Second Embodiment

Figure 3:
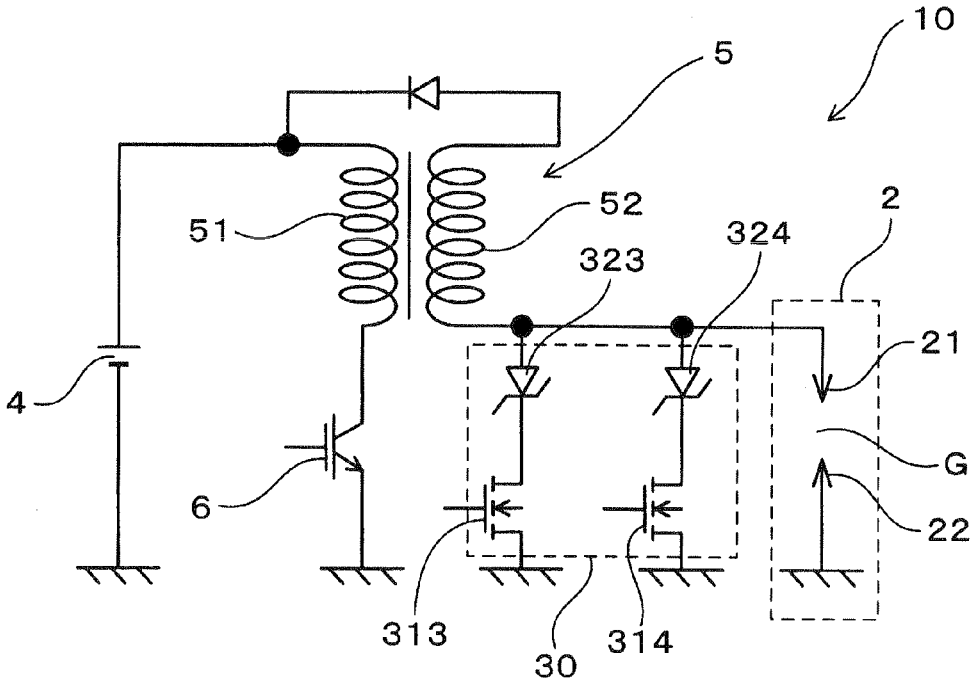
FIG. 3 is a schematic circuit diagram illustrating an ignition device according to a second embodiment of the present invention.

Referring now to FIG. 3, hereinafter is described an ignition device according to a second embodiment of the present invention. In the second and the subsequent embodiments, the components identical with or similar to those in the first embodiment are given the same reference numerals for the sake of omitting unnecessary explanation.

FIG. 3 is a schematic circuit diagram illustrating an ignition device 10 according to the second embodiment. As shown in FIG. 3, the ignition device 10 includes a voltage limiting means 30 having a configuration different from that of the voltage limiting means 3 of the ignition device 1 related to the first embodiment.

Specifically, in the ignition device 10 of the present embodiment, the voltage limiting means 30 includes two (first and second) switching elements 313 and 314 and two (first and second) Zener diodes 323 and 324. More specifically, a serial connection of the first switching element 313 and the first Zener diode 323 and a serial connection of the second switching element 314 and the second Zener diode 324 are connected in parallel with the spark plug 2 to thereby configure the voltage limiting means 30. The first and second Zener diodes 323 and 324 have Zener voltages Vz3 and Vz4, respectively, which are different from each other.

For example, the Zener voltage Vz4 of the second Zener diode 324 is set to be smaller than the Zener voltage Vz3 of the first Zener diode 323. Then, at the first stage S1 that lasts until the end of the initial discharge voltage peak, the first switching element 313 is permitted to be in an on state and the second switching element 314 is permitted to be in an off state. Thus, at the first stage S1, the voltage limiting value Vh1 becomes equal to Vz3. Then, at the second stage S2 following the initial discharge voltage peak, the first switching element 313 is permitted to be in an off state and the second switching element 314 is permitted to be in an on state. Thus, at the second stage S2, the voltage limiting value Vh2 becomes equal to Vz4. In other words, the voltage limiting value Vh2 at the second stage S2 can be made smaller than the voltage limiting value Vh1 at the first stage S1. In this case, the second switching element 314 may be turned on while the first switching element 313 is in an on state to reliably perform switching.

The rest of the configuration is similar to the first embodiment.

According to the present embodiment as well, similar to the first embodiment, an ignition device that can ensure reliability and effectively minimize consumption in the electrodes of the spark plug can be provided.

The ignition device may have various configurations other than those of the first and second embodiments. For example, the voltage limiting means may be provided on the primary side of the ignition coil. In this case, the upper limit of the primary voltage may be made variable to control the absolute value of the upper limit of the voltage applied to the spark plug at the first and second stages. Further, the voltage limiting means may be provided in the spark plug.

The constant voltage elements in the voltage limiting means are not limited to Zener diodes shown in the first and second embodiments. For example, avalanche diodes, varistors, or the like may be used as the constant voltage elements. The configuration of the voltage limiting means is not limited to the configuration that includes the constant voltage elements and the switching elements. The switching element in the voltage limiting means is not limited to a MOSFET but, for example, may be an IGBT. The switching element configuring the igniter is not limited to an IGBT but, for example, may be a MOSFET or the like.

Third Embodiment

Figure 4:
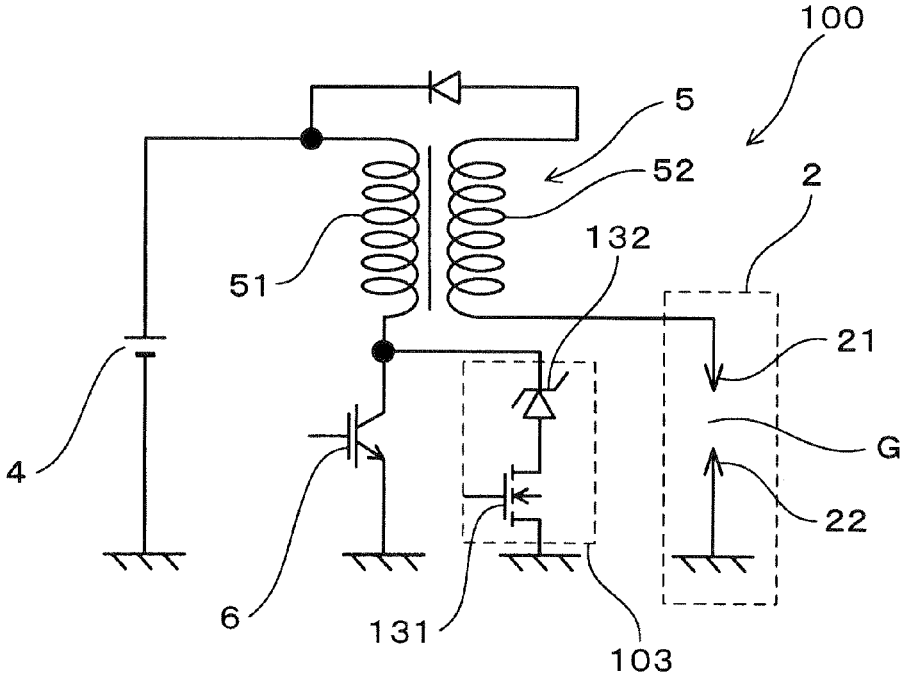
FIG. 4 is a schematic circuit diagram illustrating an ignition device according to a third embodiment of the present invention.
Figure 5:
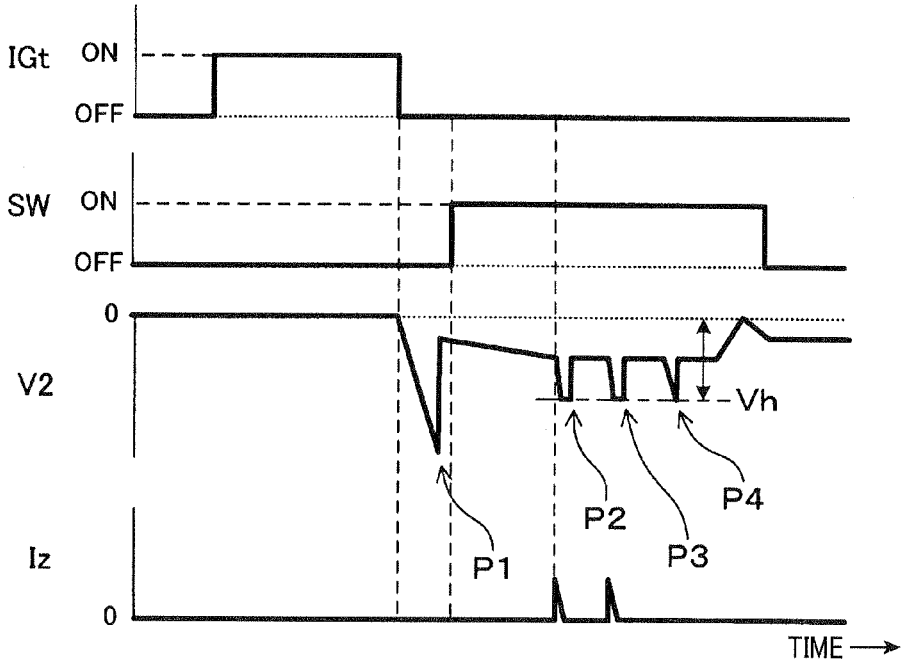
FIG. 5 is a diagram illustrating an operation of a voltage limiting circuit and time variation of secondary voltage and Zener current, according to the third embodiment.

Referring to FIGS. 4 and 5, hereinafter is described an ignition device according to a third embodiment of the present invention.

FIG. 4 is a schematic circuit diagram illustrating an ignition device 100 according to the third embodiment. As shown in FIG. 4, the ignition device 100 includes the ignition coil 5, the spark plug 2 and a voltage limiting circuit 103 as a voltage limiting means.

The ignition coil 5 is configured similar to the ignition coil 5 of the foregoing embodiments.

FIG. 5 is a diagram illustrating an operation of the voltage limiting circuit 103 and time variation of the secondary voltage V2 and Zener current. As shown in FIG. 5, the voltage limiting circuit 103 limits the absolute value of the secondary voltage V2 between the electrodes of the spark plug 2 after lapse of a discharge voltage peak initially occurs in the spark plug 2 with a supply of the electric energy from the ignition coil 5. Specifically, after lapse of the initial discharge voltage peak, the voltage limiting circuit 103 tolerates discharge between the electrodes but limits the absolute value of the secondary voltage V2 so as not to exceed a predetermined voltage limiting value Vh.

As shown in FIG. 4, the ignition device 100 includes the ignitor 6 that supplies current to the primary coil 51 or interrupts current to be supplied to the primary coil 51. The voltage limiting circuit 103 includes a switching element 131 and a Zener diode 132 that serves as a constant voltage element. The voltage limiting circuit 103 is provided on the primary coil 51 side.

The spark plug 2 is configured similar to the spark plug 2 of the foregoing embodiments.

For example, the ignition device 100 of the present embodiment may also be used for an internal combustion engine for a vehicle.

The power source 4 is a direct current power source and is configured similar to the power source described in the foregoing embodiments. The ignitor 6 is composed of a switching element and is also configured similar to the ones described in the foregoing embodiments.

Parallel connection of the voltage limiting circuit 103 and the igniter 6 is electrically connected to the primary coil 51. Specifically, a serial connection of the switching element 131 and the Zener diode 132 is electrically connected to a path connecting the primary coil 51 and the ignitor 6. The Zener diode 132 has a cathode connected to the primary coil 51 and an anode connected to the switching element 131. In the switching element 131, the side opposite to the Zener diode 132 is grounded.

The secondary coil 52 of the ignition coil 5 is connected to the center electrode 21 of the spark plug 2.

The switching element 131 of the voltage limiting circuit 103 is also configured to be turned on/off under the control of a signal issued from an electronic control unit of the internal combustion engine, not shown. When the igniter 6 is turned off and the switching element 131 is turned on, primary voltage is ensured not to exceed the Zener voltage Vz1. Accompanying this, the absolute value of the secondary voltage V2 induced in the secondary coil 52 is inhibited from exceeding the predetermined voltage limiting value Vh. The voltage limiting value Vh of the secondary voltage V2 is in a predetermined proportion to the Zener voltage Vz1. That is, the voltage limiting value Vh is determined by the ratio between the number of turns of the primary coil 51 and the number of turns of the secondary coil 52 in the ignition coil 5. For example, the ignition coil may have a ratio of the number of turns (the number of turns of the primary coil 51:the number of turns of the secondary coil 52) as expressed by 1:100. In this case, when the Zener voltage Vz1 is 50 V, the voltage limiting value Vh of the secondary voltage is set to 5 kV.

In the present embodiment, a MOSFET (MOS type field-effect transistor) is used as the switching element 131 of the voltage limiting circuit 103, and an IGBT (insulated gate bipolar transistor) is used as the switching element configuring the igniter 6.

Referring now to FIG. 5, hereinafter is described the operation of the ignition device 100 that includes the voltage limiting circuit 103 configured as described above. In FIG. 5, four graphs are vertically juxtaposed. In the graphs, each horizontal axis indicates a time axis. The symbol on the left of the vertical axis indicates an on/off state of the igniter 6 in the graph of IGt, an on/off state of the switching element 131 in the graph of SW, variation of the secondary voltage V2 in the graph of V2, and variation in the value of current that passes through the Zener diode 132 in the graph of Iz.

First, when the switching element of the igniter 6 is turned on, current passes through the primary coil 51. After that, when the igniter 6 is turned off, current supply to the primary coil 51 is interrupted. With the interruption, an induced electromotive force is generated in the secondary coil 52 and the secondary voltage V2 is applied between the center electrode 21 and the ground electrode 22 of the spark plug 2. This electric energy generates initial discharge between the electrodes of the spark plug 2. The portion indicated by P1 in the graph of V2 in FIG. 5 corresponds to an initial discharge voltage peak.

A single turn on/off operation of the igniter 6 induces electric energy that is supplied from the ignition coil 5 to the spark plug 2. In the present embodiment, the capacitive discharge initially occurs in the spark discharge gap G of the spark plug 2 by this electric energy is the initial discharge described above.

Immediately after lapse of the initial discharge voltage peak, the switching element 131 of the voltage limiting circuit 103 is turned on. This leads to the formation of a closed circuit that includes a battery 4, the primary coil 51 and the Zener diode 132. Thus, when the primary voltage has reached the Zener voltage Vz1, Zener current Iz passes through the Zener diode 132 and the electric energy of the primary coil 51 is released. In other words, the primary voltage is prevented from exceeding the Zener voltage Vz1. The timing of turning on the switching element 131 may be set, for example, on the basis of a delay time from an ignition start signal. Alternatively, a detecting means may be provided to detect the initial capacitive discharge from the primary voltage or the secondary voltage. Based on a detection signal of the initial capacitive voltage issued from the detecting means, the timing of turning on the switching element 131 can be set.

Thus, the absolute value of the secondary voltage V2 induced in the secondary coil 52 is prevented from exceeding the voltage limiting value Vh. Specifically, the absolute value of the voltage between the electrodes of the spark plug 2 is prevented from exceeding the voltage limiting value Vh. More specifically, according to the configuration of the present embodiment, when the application voltage between the electrodes of the spark plug 2 is about to exceed a predetermined voltage, the application voltage is limited to the predetermined voltage and flattened. Then, the gas in the spark discharge gap G is brought to a state suitable for discharge in a period when the application voltage is maintained at the predetermined voltage. As a result, re-discharge is permitted to occur between the electrodes. Thus, the re-discharge voltage of the spark plug 2 is prevented from being excessively increased and hence consumption of the spark plug 2 is minimized.

After the initial discharge, inductive discharge is caused in the spark plug 2. The inductive discharge, when it is blown off, is again followed by capacitive discharge and inductive discharge. The capacitive discharge (re-discharge) is indicated by point P2, P3 or P4 in the graph of V2 of FIG. 5. In the event that the initial discharge has not achieved ignition, the gas can be ignited by re-discharge during the repetition of blow-off and re-discharge. However, the voltage of the re-discharge is suppressed to not more than the voltage limiting value Vh. Thus, while consumption is minimized in the electrodes of the spark plug 2, ignitability is ensured after the initial discharge as well.

Advantageous effects of the present embodiment will be described below.

As described above, the voltage limiting circuit 103 is configured such that discharge is tolerated after lapse of the initially occurring discharge voltage peak but that the absolute value of the voltage V2 applied to the spark plug 2 is ensured not to exceed the predetermined voltage limiting value Vh. Thus, after lapse of the initial discharge voltage peak as well, ignitability of the gas is ensured fully using the electric energy supplied to the spark plug 2, while consumption of the spark plug 2 is minimized. Specifically, after lapse of the initial discharge voltage peak as well, discharge is permitted to successively occur without interruption, thereby ensuring ignitability fully using the electric energy supplied to the spark plug 2. At the same time, the absolute value of the voltage of the discharge (re-discharge) that successively occurs after lapse of the initial discharge voltage peak can be made equal to or smaller than the predetermined voltage limiting value Vh. Thus, when the predetermined voltage limiting value Vh is set to a value that would hardly induce consumption of the spark plug 2, consumption of the spark plug 2 is minimized and at the same time the ignitability is ensured.

Since the voltage limiting circuit 103 is composed of the switching element 131 and the Zener diode 132, the voltage limiting value Vh can be correctly set at desired timing. In addition, use of the Zener diode 132 enables fine setting of the voltage limiting value Vh.

Further, since the voltage limiting circuit 103 is provided on the primary coil 51 side, the withstand voltage of the switching element 131 or the Zener diode 132 can be made small and hence the size and cost of the device can be easily reduced.

As described above, the ignition device provided by the present embodiment has good ignitability but can minimize consumption of the spark plug.

Fourth Embodiment

Figure 6:
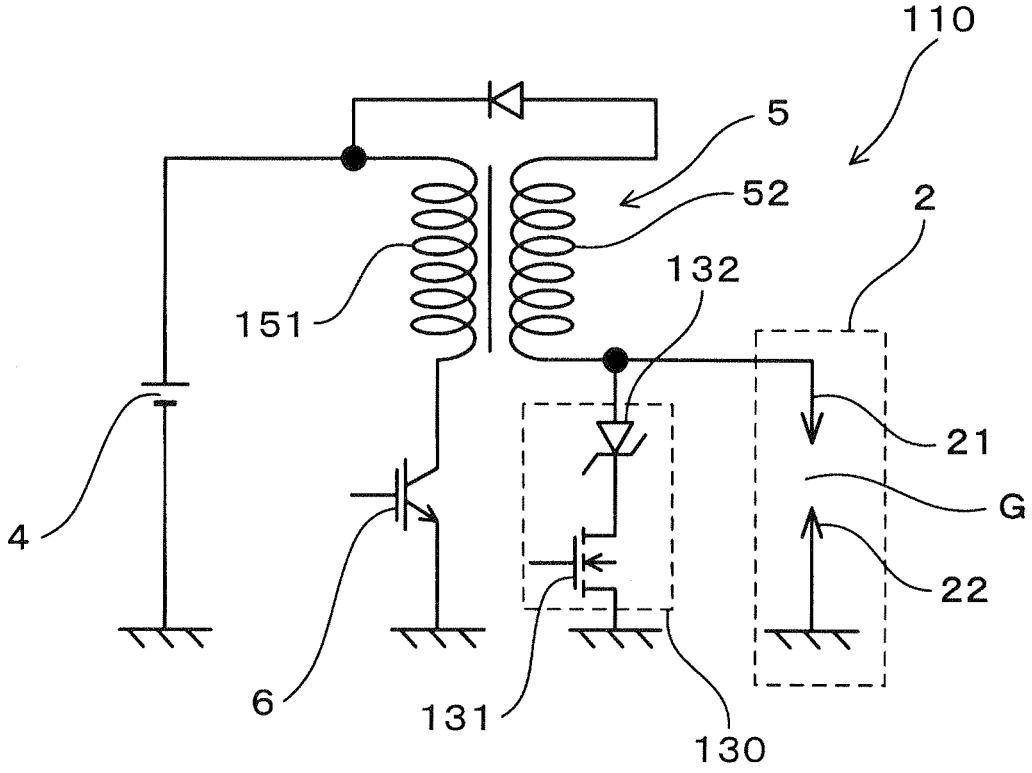
FIG. 6 is a schematic circuit diagram illustrating an ignition device according to a fourth embodiment of the present invention.

Referring to FIG. 6, a fourth embodiment of the present invention is described. FIG. 6 is a schematic circuit diagram illustrating an ignition device 110 according to the fourth embodiment. As shown in FIG. 6, the ignition device 110 includes a voltage limiting circuit 130, as a voltage limiting means, which is arranged on a high voltage side of the secondary coil 52.

Specifically, in the ignition device 110 of the present embodiment, a serial connection of the switching element 131 and the Zener diode 132 configuring the voltage limiting circuit 130 is electrically connected to a terminal in the secondary coil 52, the terminal being on the spark plug 2 side. The voltage limiting circuit 130 is electrically connected in parallel with the spark plug 2.

Specifically, the voltage limiting circuit 130 is configured such that the anode of the Zener diode 132 is connected to the secondary coil 52, the cathode of the Zener diode 132 is connected to an end of the switching element 131, and the other end of the switching element 131 is grounded.

Thus, when the switching element 131 is turned on, the secondary voltage V2 applied to the spark plug 2 is inhibited from exceeding the Zener voltage Vz2 of the Zener diode 132. Specifically, after lapse of the initial discharge voltage peak, the secondary voltage V2 is applied to the spark plug 2. In this case, in the present embodiment, the voltage limiting value Vh that is an upper limit of the absolute value of the secondary voltage V2 is ensured to become equal to the Zener voltage Vz2 of the Zener diode 132.

The rest of the configuration is similar to the third embodiment.

Similar to the third embodiment, the present embodiment can also provide an ignition device which is able to ensure ignitability but effectively minimize consumption in the electrodes of the spark plug.

The ignition device may have various configurations other than those of the third and fourth embodiments. For example, the voltage limiting means may be provided in the body of the ignition coil or in the spark plug.

What is claimed is:

1. An ignition device, comprising:

an ignition coil provided with a primary coil and a secondary coil which are magnetically coupled with each other;

a spark plug provided with a center electrode and a ground electrode, discharge sparks being generated between the center electrode and the ground electrode by an application of voltage between the center and ground electrodes, the voltage being applied using electric energy responding to magnetic energy stored in the ignition coil; and voltage limiting means for limiting the voltage applied between the electrodes of the spark plug such that the voltage has an absolute value limited below a predetermined voltage limiting value, wherein the voltage limiting value is differentiated from each other in first and second stages, the first stage being defined as a period in which an initial discharge peak ends, the initial discharge peak being initially generated by the electric energy, the second stage being defined as a period after the end of the initial discharge peak, wherein the voltage limiting value in the first stage is lower than the voltage limiting value in the second stage.

2. The device of claim 1, wherein the voltage limiting means is configured such that the voltage limiting values in the first and second stages are interchangeable.

3. The device of claim 2, wherein the voltage limiting means is arranged to be connected to the secondary coil.

4. The device of claim 3, wherein the voltage limiting means is provided with a switching element electrically and selectively turned on and off and a constant voltage element electrically driven.

5. The device of claim 4, wherein the switching element and the constant voltage element are electrically serially connected to each other.

6. The device of claim 3, wherein the voltage limiting means is provided with a switching element electrically and selectively turned on and off and a plurality of constant voltage elements each electrically driven.

7. The device of claim 6, wherein the plurality of constant voltage elements are electrically connected in series to each other;

the switching element is electrically connected to a path connecting two constant voltage elements electrically connected to each other, the two constant voltage elements being included in the plurality of constant voltage elements; and the voltage limiting means is electrically parallelly connected with the spark plug.

8. The device of claim 2, wherein the voltage limiting means is provided with a switching element electrically and selectively turned on and off and a constant voltage element electrically driven.

9. The device of claim 8, wherein the switching element and the constant voltage element are electrically serially connected to each other.

10. The device of claim 2, wherein the voltage limiting means is provided with a switching element electrically and selectively turned on and off and a plurality of constant voltage elements each electrically driven.

11. The device of claim 10, wherein the plurality of constant voltage elements are electrically connected in series to each other;

the switching element is electrically connected to a path connecting two constant voltage elements electrically connected to each other, the two constant voltage elements being included in the plurality of constant voltage elements; and the voltage limiting means is electrically parallelly connected with the spark plug.

12. The device of claim 1, wherein the voltage limiting means is provided with a switching element electrically and selectively turned on and off and a constant voltage element electrically driven.

13. The device of claim 12, wherein the switching element and the constant voltage element are electrically serially connected to each other.

14. An ignition device, comprising:

an ignition coil provided with a primary coil and a secondary coil which are magnetically coupled with each other;

a spark plug provided with a center electrode and a ground electrode, discharge sparks being generated between the center electrode and the ground electrode by an application of voltage between the center and ground electrodes, the voltage being applied using electric energy responding to magnetic energy stored in the ignition coil; and voltage limiting means for limiting the voltage applied between the electrodes of the spark plug such that the discharge between the electrodes is permitted and the voltage applied between the electrodes after an end of an initial discharge voltage peak has an absolute value limited below a predetermined voltage limiting value, the initial discharge voltage peak being initially generated by the electric energy.

15. The device of claim 14, wherein the voltage limiting means is arranged to be connected to the secondary coil.

16. The device of claim 15, wherein the voltage limiting means is provided with a switching element electrically and selectively turned on and off and a constant voltage element electrically driven.

17. The device of claim 16, wherein the switching element and the constant voltage element are electrically serially connected to each other.

18. The device of claim 14, wherein the voltage limiting means is arranged to be connected to the primary coil.

19. The device of claim 18, wherein the voltage limiting means is provided with a switching element electrically and selectively turned on and off and a constant voltage element electrically driven and the switching element and the constant voltage element are electrically serially connected to each other.

* * * * *